US009119518B2

(12) United States Patent
Hruby

(10) Patent No.: US 9,119,518 B2
(45) Date of Patent: Sep. 1, 2015

(54) ORBITUAL SURFACE CLEANING APPARATUS

(76) Inventor: Jeffrey T. Hruby, Vista, CA (US)

( * ) Notice: Subject to any disclaimer, the term of this patent is extended or adjusted under 35 U.S.C. 154(b) by 0 days.

(21) Appl. No.: 13/494,023

(22) Filed: Jun. 12, 2012

(65) Prior Publication Data

US 2012/0246848 A1 Oct. 4, 2012

Related U.S. Application Data

(63) Continuation of application No. 13/515,176, filed as application No. PCT/US2009/068467 on Dec. 17, 2009, now Pat. No. 8,839,479.

(60) Provisional application No. 61/285,930, filed on Apr. 6, 2009.

(51) Int. Cl.

| | |
|---|---|
| ***A47L 11/12*** | (2006.01) |
| ***A47L 11/14*** | (2006.01) |
| ***A47L 11/40*** | (2006.01) |
| ***A47L 11/162*** | (2006.01) |
| ***A47L 11/164*** | (2006.01) |
| ***A47L 11/32*** | (2006.01) |

(52) U.S. Cl.

CPC ..... *A47L 11/4075* (2013.01); *A47L 11/12* (2013.01); *A47L 11/14* (2013.01); *A47L 11/162* (2013.01); *A47L 11/164* (2013.01); *A47L 11/1625* (2013.01); *A47L 11/32* (2013.01); *A47L 11/4038* (2013.01); *A47L 11/4061* (2013.01); *A47L 11/4069* (2013.01); *A47L 11/4083* (2013.01)

(58) Field of Classification Search

USPC ..... 15/49.1, 50.1, 98; 451/350, 353, 357, 451/359

See application file for complete search history.

(56) References Cited

U.S. PATENT DOCUMENTS

| | | | | | |
|---|---|---|---|---|---|
| 1,554,622 | A | * | 9/1925 | Chancellor | 15/50.1 |
| 2,967,315 | A | * | 1/1961 | Helbig et al. | 15/49.1 |
| 3,203,707 | A | * | 8/1965 | Anderson | 280/655.1 |
| 3,204,272 | A | * | 9/1965 | Greene et al. | 15/49.1 |
| 3,348,254 | A | * | 10/1967 | Storm, Jr. et al. | 15/49.1 |
| 3,550,324 | A | * | 12/1970 | Gerry | 451/259 |
| 4,791,694 | A | * | 12/1988 | Itaya et al. | 15/97.1 |
| 5,203,046 | A | * | 4/1993 | Shaw | 15/98 |
| 5,253,384 | A | * | 10/1993 | Joines et al. | 15/98 |
| 5,355,542 | A | * | 10/1994 | Oreck et al. | 15/49.1 |
| 6,616,517 | B2 | * | 9/2003 | Palushi | 451/350 |
| 6,938,295 | B1 | * | 9/2005 | Lancaster et al. | 15/49.1 |

FOREIGN PATENT DOCUMENTS

| | | | |
|---|---|---|---|
| JO | 200-41926 | * | 2/2000 |
| WO | 93/18700 | * | 9/1993 |

* cited by examiner

*Primary Examiner* — Mark Spisich

(74) *Attorney, Agent, or Firm* — Donn K. Harms

(57) ABSTRACT

A floor treatment device having a handle assembly having a pair of handles at one end and a rotational engagement to a frame at the other. A head assembly, having a motor and flywheel and offset drive for a pad, is rotationally engaged to the frame to allow all the components to tilt over uneven surfaces. The handles are positioned vertically to provide an ergonomic grip for users. Enhanced orbital operation of the cleaning or other pad is yielded by system of paired weights on the flywheel. A spray system is also engageable to the device.

4 Claims, 4 Drawing Sheets

ORBITUAL SURFACE CLEANING APPARATUS

This application is a continuation in part application of U.S. application Ser. No. 13/515,176 filed on Jun. 11, 2012 now U.S. Pat. No. 8,839,479 which claims priority to International Application PCT/US09/68467 filed on Dec. 17, 2009, which claims priority to U.S. provisional application Ser. No. 61/285,930 filed on Apr. 6, 2009 all of which are respectively incorporated herein in their entirety by this reference thereto.

BACKGROUND OF THE INVENTION

1. Field of the Invention

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

The present invention relates to surface cleaning device. More particularly the invention relates to orbital surface cleaning devices.

2. Prior Art

Conventional floor cleaning devices generally include cleaning head assemblies with handles engaged thereon. Head assemblies generally consist of a drive motor (electric or gas powered) which are mounted to a separate frame, which drives a flywheel and drive plate which are mounted on the end of a handled frame.

Orbital cleaning devices generally employ cleaning head assemblies with flywheels having offset weight configurations in order to achieve orbital cleaning motion of a cleaning pad engaged to the drive plate. The weights are employed to achieve desirable cleaning oscillations which provides improved cleaning characteristics in comparison to pure rotational devices.

Such conventional orbital as well as rotational surface cleaning devices, tend to be heavy, bulky, and cumbersome to operate, even with exceptional knowledge of the device. It is widely known that orbital floor cleaning devices in particular tend to exacerbate the negative aspects commonly associated with floor cleaning devices due to the need to balance the oscillation and rotation of the drive plate. This is especially true when such conventional floor cleaning devices are placed in the hands of less skilled personnel who must learn the delicate art of turning and repositioning conventional devices upon the surface being cleaned, without damaging it.

Unfortunately, manufacturers continue to produce such devices which must be formed in a manner to be heavy in order to counterbalance vibrational and rotational motions of the weights which must be employed to counter balance the weight of the polishing and cleaning component. The result is a difficult-to-use device that provides an uncomfortable experience for the user. For example, U.S. Pat. No. 5,355,542 to Oreck et al. titled "Orbiter Floor Apparatus", granted Oct. 18, 1994, describes a floor cleaning device that is bulky, difficult to use, and is prone inherently to vibrate excessively, and lacks sufficient performance (insufficient dirt extraction, cleaning).

One issue with the device to Oreck is that the configuration of the various components and weights on one side surface of a flywheel are required to achieve the desired orbital motion. However the taught configuration is adapted to produce excessive vibration and directional turning in a manner requiring a leaning of the device, sometimes in an opposite direction of the desired turn. The result is therefor a device which is difficult to handle, prone to damaging the surface being cleaned if not turned by an experienced user, and lacking in user comfort.

Such approaches are considered disadvantageous because the parts employed to create the orbital motion also create numerous stresses and vibrations during use in the planes both normal to and parallel to the flywheel and drive plate. Over extended period of use, the flywheel and other components can potentially break apart due to such stresses. A more ideal orbital floor cleaning system would utilize fewer parts with higher precision to generating desirable motion, while also balancing user comfort.

Another issue with the device of Oreck and similar devices is that they fail to meet the industry standards as a deep cleaner for carpets and rugs (see the Carpet and Rug Institute Seal of Approval Program at www.carpet-rug.org) This limits the desirability of such a device in many industries including hotels, motels, theme parks, and other locations where meeting industry standards are desired.

Further, conventional orbital cleaning device provide cleaning head assemblies engaged to steering handles which are positioned for operative use at substantially horizontal angles relative to the horizontal surface being cleaned. This positioning limits the user ability to maneuver the device around obstacles while changing directions, performing maintenance, and overall comfort during use. Such a configuration, providing an inline communication with the operative head, will also transmit vibrations from the cleaning head to the handles more easily, and is further undesirable in that manner.

Still further, the device to Oreck and others do not provide an device that may partially rest on wheels during operation of the machine, due to the nature of their operation and turning, making it difficult to guide and maneuver prior art polishers during operation. In addition, many devices employ liquid dispensers which rely on a gravity-fed cleaning solution dispenser, which can lead to over wetting and lack of moisture control on the work surface.

What has yet to be appreciated is a floor cleaning device having modular parts to allow users to quickly adapt the device for a particular purpose. Further when adapted to a particular cleaning purpose, such an device should include an orbital head assembly configured with few parts, thus eliminating costly maintenance or downtime. Still further, such a device should provide an orbital head which allows for quick changing of the working components during a job, as they wear or become soiled. Furthermore, the modularity of such a device should be configured so as to avoid the potential damage caused by turning and situational used of conventional orbital polishers to thereby enable nontechnical users to use the device with less training and quickly replace parts, to upgrade the device, or otherwise configure the device for a target application.

A modular device allows for easily disassembly of the device down and transporting it to new locations. Such an approach can be advantageously employed while maintaining a comfortable experience for the user. Further, such a device should be configured to lessen or minimize the stress communicated to the hands and arms of users during employment of the device through the provision of improved handle grips. In addition, it has yet to be appreciated that an orbital floor cleaning device can meet industry standards and requirements for all work surface types (e.g., carpets, rugs, hard floors, concrete, wood, stone, tile, grout, brick, vinyl/fcv/linoleum, etc).

As such, there is a continuing unmet need for an improved orbital cleaning device which solves the problems associated in prior art.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of an orbital floor cleaning device and system allowing an improved method for employment with multiple types of floor surfaces. The device employs a folding handle assembly having handle grips which in operative positioning are traverse to the direction of the assembly formed by members communicating with a frame rotationally engaged to the orbital cleaning head assembly. The traverse positioning minimize the transmitted vibration from the head assembly and increase the user's ability to steer the device in use, and provide a means for ergonomic positioning of the user's hands during use.

In a particularly preferred mode of the disclosed device, the orbital floor cleaning device comprises a head assembly rotationally engaged to a frame which is rotationally engaged to the handle assembly. This configuration with traverse handle direction, allows the majority of the operating vibrations and stresses to remain in the head assembly and limits the transfer of vibration to the handle and therefor the user because the vibrations tend to stay inline with the axis of the member to which they are communicated initially.

A great advantage is found over art in the overall performance of the device in aspects of user comfort, performance, and handling of the device. The rotational engagement of the entire head assembly, including the motor, to the frame, which itself is rotationally engaged to the handle assembly, further allows the user to rotate the head assembly into a maintenance position where the pad drive is exposed for ease of replacing cleaning or polishing pads, and performing other maintenance. Because the motor is a part of the head assembly, it rotates with the assembly and maintains it access over uneven surfaces. Further, this inclusion of the motor into the rotating assembly makes maintenance extremely easy in that the entire assembly with motor can be changed in a matter of minutes, and can be worked on as a complete functioning component unlike other devices which separately mount the motor to a frame.

Preferred head assemblies comprise the driver motor, a flywheel a bearing assembly, and a pad driver operating in an orbital rotationally engagement. The rotational power from the motor couples through a base of the assembly, to the flywheel via a drive shaft. The flywheel includes one but preferably a plurality of opposing, offset weights, which are positioned on both side surfaces of the flywheel in a manner to minimize vibration and wobble to the flywheel and also as a means to induce enhanced rotational motion onto the pad driver. This pad driver is engaged along a second axis off center to that of the flywheel and motor via the bearing assembly.

In a particularly preferred mode of the device, the flywheel comprise at least three pairs of opposing weights, two pair of which mounted on opposite side surfaces of the flywheel and which are substantially equal in weight and mass. Additionally preferred, at least one additional pair of weights substantially smaller than those of the first two pair, are mounted in opposing positions on both sides of the flywheel. It has been found that many advantages of this configuration are provided which enhance the utility of the device.

By providing all weights engaged on opposing sides of the flywheel, the side of the flywheel to which they engage is balanced in the plane parallel to the plane of the flywheel, reducing the chance of an unbalanced wobble normal to the flywheel during use. This reduces any vibration that can be communicated to the user.

Further, the smaller pair of weights, is provided to deliberately slightly offset the balance of the flywheel by enhancing its mass in one point along the plane of the flywheel. This positioning of enhanced mass provides a means for imparting an improved inertial thrust force and motion as the flywheel rotates. This thrust force and motion operates much like a sling and stone by producing a moment in the rotation of the flywheel of enhanced mass rotation which causes an enhanced oscillation of the pad driver from this device without it. This moment of thrust enhances the induced rotation of the pad in the oscillating motion. A bearing assembly is disposed between the flywheel and the pad driver to allow for smooth oscillating and rotating motion of the engaged pad driver and pad.

Preferred handle assemblies can include one or more advantageous features. For example, the handle assembly can comprise one or more hinge connectors that allow the handle to fold back on itself, preferably through an approximately 180 degree angle. This folding allows the handle to be stored to a reduced overall size of the handle, and of the device. In this stored mode, the handle assembly may optionally but preferably additionally a hitch, or other means to engage the device to the back of a service vehicle, such as a golf cart. This will provide the user with a means to engaged the device, supported upon the wheels, for a towing for long distance movement on a venue such as an amusement park or large hotel.

The handle assembly include grips components disposed at the distal ends which are disposed orthogonally to axis of the handle. This positioning advantageously provides a means for ergonomic griping of the device during use by the hands of a user which substantially reduce fatigue of the user over extended periods of operative employment of the device. The grips may also include one or a plurality of actuator means used to control the device. Further, the traverse direction of the grips, when positioned during operation of the device, minimizes the communication of vibration traveling along the axis of the handle.

In other modes, the device preferably includes a spray assembly for dispensing cleaning solution or other fluid to the underlying surface being cleaned or resurfaced. The spray assembly includes one or a plurality of rotationally engaged spray nozzles, a bottle cartridge, a cartridge mount, means to communicate fluid from the bottle to the nozzle, and optionally a means to heat the fluid. The bottle cartridge system may be provided wherein the user is provided with a plurality of pre-filled bottle cartridges having appropriate solution mixtures, which may be changed quickly. The bottle cartridges are configured to mate in a fluidly sealed engagement with a cartridge mount which is in fluid communication with the nozzles directly or through pumps, valves, and other components. Thus an engaged cartridge in the cartridge mount, communicates the fluid from the cartridge shown as a bottle or bottles, to the nozzles. This cartridge system saves times and relieves the hassle to the user of having to mix various cleaning solutions when the bottle runs low.

In another mode of the bottle cartridge system, there is included a plurality of pairs of bottles functioning as fluid cartridges with at least one filled with water and at least one other filled with a concentrate of cleaning solution. One or both cartridges can be removably engageable to the mount providing the sealed fluid communication means, and mixing can be accomplished as the fluids are communicated to the spray nozzle(s) such as through valves or venturies. In this fashion water in one cartridge is easily replenished while the concentrate remains on the device and mixes in a predetermined fashion adapted for the job at hand. A dial engaged to a valve or similar means for proportioning provides a means to change the ratio of water to the concentrate may also be provided.

In other preferred modes of the invention, the orbital floor cleaning device comprises one or a plurality of field-replaceable components. For example, the following parts can be replaced by non-technical individuals: flywheel, pads, driver motors, bottle cartridges, spray assemblies, or other parts. Modularity of flooring cleaning device allows for ease of maintenance or ease of transport and ease of reconfiguring the device for different surfaces.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of this invention to provide an orbital polisher or cleaner which minimizes vibration communicated to the hands of a user.

It is another object of this invention, to provide such an orbital device, which is modular and easily configured and maintained with easily engaged or changed components.

It is a further object of this invention, to provide an orbital polisher and cleaner, which employees a weighted flywheel which minimizes vibration and maximizes the orbital thrust communicated to an engaged pad.

It is yet another object of this invention, to provide such a device, which positions the orbital pad substantially parallel to the surface being cleaned, even during turns of the device.

It is yet a further object of the device to provide such an orbital cleaning and polishing device which employs wheels which provide a triangulated support in combination with the pad during use, and which may be employed for transport or maintenance with the paid elevated thereon.

These and other objects of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 8:
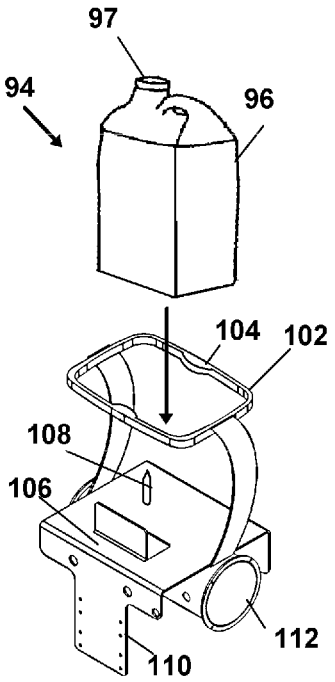
FIG. 8 illustrates a preferred mode of the cartridge system employable on the device wherein premixed bottle cartridges are engageable into a cartridge mount provided by the bottle holder frame and employing a piercing member for piercing the inserted cartridge bottle to achieve a sealed fluid communication of fluid to the spray nozzles through a pump or other fluid communication means.
Figure 8A:
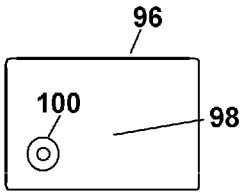

FIG. 8*a* shows a view of the bottom surface of a preferred cartridge system of FIG. 8 comprising a weakened portion which is sealably engageable in a registered engagement with the piercing member of the holder frame.

Figure 9:
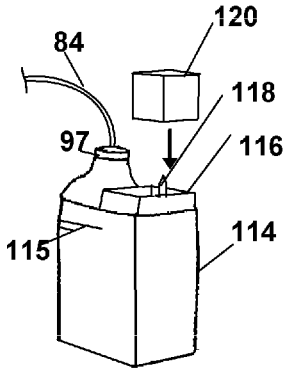

FIG. 9 depicts another preferred cartridge system having removable cartridge of concentrate which are engageable to a cartridge mount or to a main bottle cartridge.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Various elements or parts of the disclosed device can be configured to be easily replaceable with like-configured parts in situ, thus allowing for modification of the device by an unskilled user. Parts of the system can be easily removed through one or more mechanical connectors, possibly comprising wing nuts, hook-and-loop fasteners (e.g., Velcro™), or other mechanical connectors as would occur to those in the art such as any of those in the 2009 GRANGER fastener catalog M-Q504-07E 8SP2803 which in made part hereof. Any fastener herein can be considered substitutable by the appropriate fastener in the above noted catalog as would occur to those skilled in the art. It is noted and anticipated that the various elements are considered to be field replaceable in situ, even if the following disclosure lacks such assertions.

Figure 1:
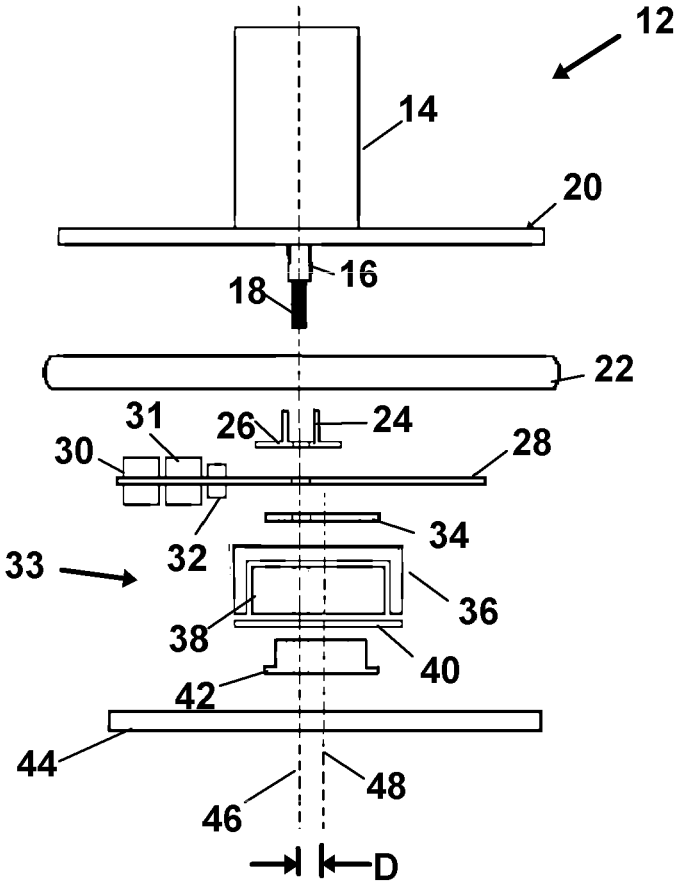
FIG. 1 is an exploded view of a particularly preferred orbital cleaning head assembly of the device showing the axis of the flywheel and motor and secondary axis of the orbital pad.

Now referring to drawings in FIGS. 1-9, wherein similar components are identified by like reference numerals, there is seen in FIG. 1 a particularly preferred mode of the cleaning head assembly 12 of the orbital surface cleaning device 10. As is shown, the rotationally engaged head assembly 12. The head assembly has operatively engaged, means for powered rotation, such as an electric motor 14, which is preferably disposed on an upper surface of substantially circular base portion 20 of the head assembly 12. It is noted that the device 10 may include any suitable rotational driving means known in the art, such as an internal combustion engine or hydraulicly powered motor, and should not be considered limited to an electric motor only.

In a particularly preferred mode, the motor 14 is mechanically engaged to the base component 20 using fasteners adapted to the task. The motor 14 includes a drive shaft 16 that project through an aperture in the engaged base component 20 to provide an operative communication of powered rotation to the various additional components which are disposed on the assembly at the underside of base 20, and are described immediately below. It is noted that the components shown in the figure are not to scale and additional components may be added, and that some of the component may be employed without others in forms of the device 10 with less utility and such are anticipated within the scope of this patent.

Drive shaft 16 can include an axial passaged with a threaded interior configured to receive a threaded pin or set screw 18. In a preferred mode, the shaft 16 is about ⅝ inches (about 1.59 centimeters) in diameter, however other suitable sizes and configurations are possible and anticipated. The set screw 18 can have a diameter of ⅜ inches (about 0.95 centimeters) and can screw into a threaded receiving axial cavity of shaft 16.

The set screw 18 is preferably employed to mechanically engage the flywheel 28 and flywheel-engaged bearing assembly 33, to the motor 14, using the preferred support shaft 24 which provides means to reinforce the engagement to the flywheel 28 and prevent tilting of the flywheel 28 during rotation. Drive shaft 16 can be inserted through the clearance apertures in the shaft support 24, flywheel 28, and spacer 34 to communicate to a threaded engagement within a wall of the bearing assembly 33. The pad driver 44 is then engaged directly to the center 42 of the bearing assembly 33 in line with a second axis. The path for the drive shaft 16 through clearance apertures is shown by dashed lines in the respective components, through which the driveshaft passes, along the first axis of centerline 46.

Further, as can be seen, the engagement of the set screw 18 is disposed along the first axis or first centerline 46, defining the centerline axis of the rotation of drive shaft 16. Still further, the center of the bearing assembly 33 and thus the pad driver 44, are offset a distance 'D' from the first centerline 46 and comprise a second centerline 48 of the bearing assembly 33 and pad driver. The offset distance 'D' essentially defines a radius of oscillation of the pad driver 44, when operatively employed. This is described in more detail later.

The shaft support 24 is particularly preferred and is configured to shroud and slide upon to reinforce drive shaft 16 against stresses normal to the axis, resulting from vibration of the flywheel and head assembly 12 during use. More particularly, the shaft support 24 has a central aperture (shown as a dashed line) with an inner diameter sized at very high precision in order to ensure a tight press-fit or engagement with the outer diameter of drive shaft 16. This tight tolerance press-fit, and the shaft support 24 operatively engaged, provides a means for minimizing wobble and vibration that may occur during use, as is an advantage over prior art. Furthermore, shaft support 24 has an annular lip portion 26 that circumferentially extends at a substantially 90 degree angle from drive shaft 16, along a contact with the upper surface of the flywheel, and provides further support to the flywheel against tilting and misalignment under load or when spinning.

The 90 degree angle has also been machined with extremely to ensure that vibration is reduced. Finally, the centricity of the aperture with respect to the lip portion 26 on shaft support 24 is preferably positioned with very high tolerances in order to provide proper balance and minimal vibration during use. The extension of the annular lip portion 26 of shaft support 24 is not mere design choice, rather, it has been carefully developed in order to achieve sufficient support to the central portion of the flywheel 28 to resist breakage (and pad driver 44) while still allowing a desired amount of flexibility in the flywheel 28.

Figure 2:
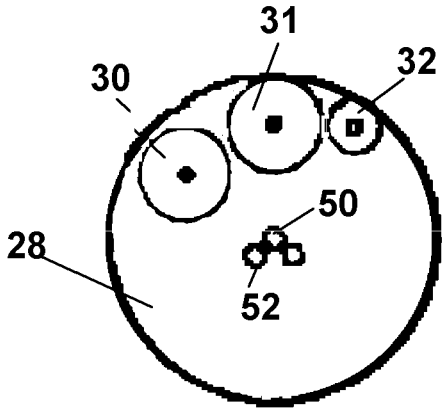
FIG. 2 shows a top view of a preferred flywheel component of the head assembly employing a plurality of sets of opposing weights on both side surfaces of the flywheel for balancing the flywheel to the load of the pad and for driving the oscillatory and rotational motion of the pad driver.

The flywheel is disposed normal to and adjacent the staff support 24 as shown. Preferably the flywheel 28 comprises one or a plurality of sets of opposing weights 30, 31, 32 distributed asymmetrically around plate. In a particularly preferred mode, the flywheel 28 comprises at least three pairs of opposing substantially circular weights 30, 31, 32 engaged to opposite side surfaces of the flywheel 28 as shown to balance the weight of the pad and pad plate during oscillations or orbital motion thereof. In accordance with at least one preferred mode, at least two pairs of weights 30, 31 are substantially similar in size and mass, while the remaining pair 32 is substantially smaller than the others pairs of weights 30, 31. FIG. 2 shows a top view of the preferred flywheel 28 configuration showing the weights 30, 31, 32, clearance aperture 50, and additional apertures 52 employed to receive mechanical fasteners. The different pairs of weights 30, 31, and 32 are distributed within the flywheel 28, and pair of weights 32 is smaller than the pairs 30 and 31.

Many advantages of this configuration are present. By providing weights 30, 31, 32 engaged on opposing sides of the flywheel 28, the flywheel 28 is balanced in the plane parallel to the plane of the flywheel 28, reducing the chance of an unbalanced wobble during use.

Figure 3:
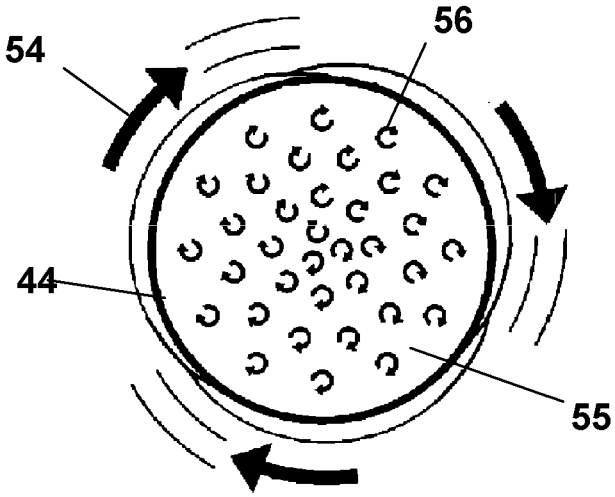
FIG. 3 illustrates a pattern of rotation and oscillations resulting from the disclose configuration of an orbital head assembly at a ratio relative to the rotations of the motor.

Further, the positioning of smaller set 32 is provided to deliberately offsets the balance of the flywheel 28 in the plane of the flywheel 28, such that when the flywheel 28 is rotated, the configured weights provide an enhanced inertial thrust force moment to induce an enhanced rotation 54 of the pad driver 44, and pad 55, about the second centerline 48 as the pad driver 44 is oscillated 56 about the first centerline 46, as shown in FIG. 3. The two pair of weights 30 and 31 are substantially equal in weight and mass in this arrangement, and the enhanced inertial thrust force has been found to occur with the individual smaller weights 32 formed of a weight which is a ratio between 15 to 50 percent of the weight of one of the larger weights 30 and 31. This configuration provides the enhanced thrust but minimizes any vibration which might damage the flywheel.

Rotational ratios are also preferred. For example, with a one horsepower motor on 110 volt single phase current at 60 cycles, a rotation 54 of 1,725 revolutions per minute (RPM) can be achieved while also inducing a 1,725 RPM oscillations 56 having a ⅜ (plus or minus ¼) inch diameter. In other preferred modes the flywheel 28 allows a user to adjust positions of weights 30, 31, 32, possibly via one or more apertures or slots disposed about flywheel 28.

Adjacent the flywheel 28 may include one or more washer or spacers 34 to provide spacing between plate 28 and bearing assembly 33, further providing a means to balance the configured head assembly 12.

The bearing assembly 33 is illustrated as being engaged to the flywheel in a position to be symmetric about the second centerline 48. In a preferred mode, bearing assembly 33 has an offset shaft clearance aperture (shown as a dashed line). The offset clearance aperture coupled with the movement of weights 30, 31, 32 allows the pad driver 44 to rotate about the bearing centerline 48 as well as oscillate or orbitally rotate about a shaft centerline 46.

Bearing assembly 33 preferably comprises bearing housing 36 in which is disposed a bearing 38. Bearing center 42 fixedly engages into the rotating annular recess at the annular race at the center of bearing 38. Bearing center 42 can be held adjacent to the housing 36 and engaged within bearing 38 using a retaining ring 40, where retaining ring 40 is configured for a mechanical coupled to housing 36. As noted the center of the bearing 38 aligns along the second axis 48 spaced from that of the motor.

The pad driver 44 is depicted as plate or substantially disk-shaped component which is coupled to the bearing center of the bearing assembly 33. Cleaning pads 55 (FIG. 3) can be engaged to the underside surface of pad driver 44 using hook and loop fabric, or other fasteners adapted to the task.

In operation, the motor 14 rotates the flywheel 28 which is engaged in an offset fashion to the bearing assembly 33. During rotation of the flywheel 28, this offset causes pad driver 44 rotate and to concurrently oscillate or orbitally rotate about the shaft centerline 46 using power from the rotation of drive shaft 16.

Pad driver 44 is operatively engaged to the annular portion forming the bearing center 42 via mechanical fasteners, or in a press fit or other means of engagement. The rotation of the configured weights, 30, 31, 32, in addition to balancing the flywheel 28 for the mass of the underlying offset components, and particularly with the inclusion of the smaller opposing weights 32, induces an enhanced thrust motion moment to the pad driver 44 rotationally engaged to the offset bearing assembly 33, and causes the pad driver 44 to additionally rotate about the bearing centerline 48. This rotating and oscillated motion of the pad driver 44 is of great advantage over prior art, in that a minimal vibration is produced and orbital rotation is achieved. Together with these two motions drive the orbital/oscillating drive motion of the device 10 (FIG. 3).

Figure 4:
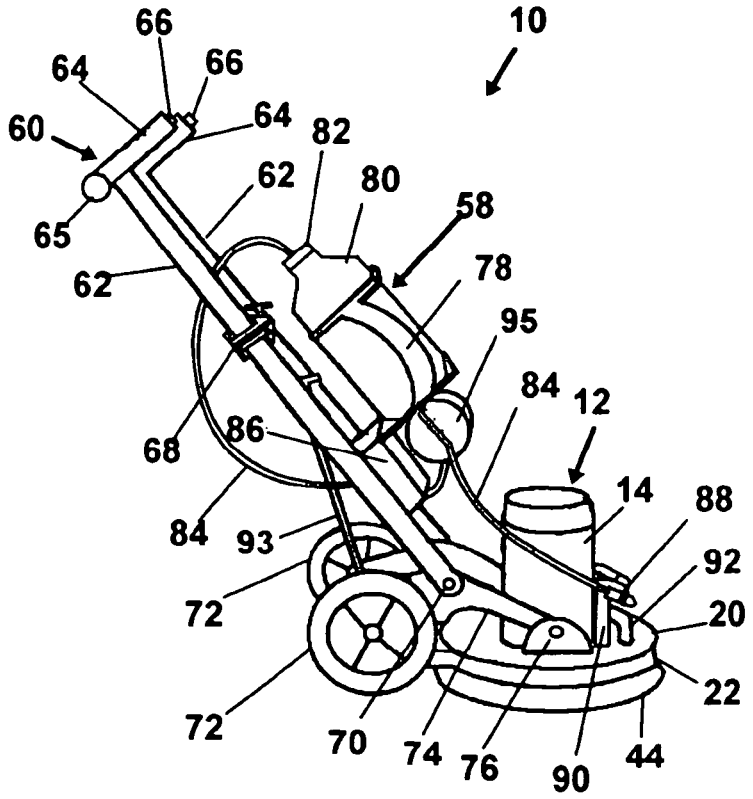
FIG. 4 illustrates a perspective elevated view of a preferred mode of the device comprising a head assembly of FIG. 1, a cartridge engageable reservoir communicating fluid to a spray assembly, and handle assembly.

FIG. 4 shows a side view of a preferred mode of the modular orbital surface cleaning device 10, which can comprise handle assembly 60, cleaning head assembly 12, and a spray dispensing assembly 58. Each handle assembly 60 preferably comprises strut portions 62 extending from a rotational engagement 70 with a frame formed by the pair of lever arms 74 which engage with the axle at one end and are engaged to the head assembly 12 at an opposite end. The handle assembly extends to grips 64 disposed at the opposite end from the rotational engagement 70. Note that the grips 64 are orthogonal to a plane defined by the main struts 62 of the handle assembly 60 as opposed to laying within the same plane as in traditional approaches. This provides a comfortable and ergonomic gripping means for the user and is of great advantage as it allows them to maintain the thumb side of their forearms aligned with the front of their biceps in a natural position while gripping the handles.

Figure 6:
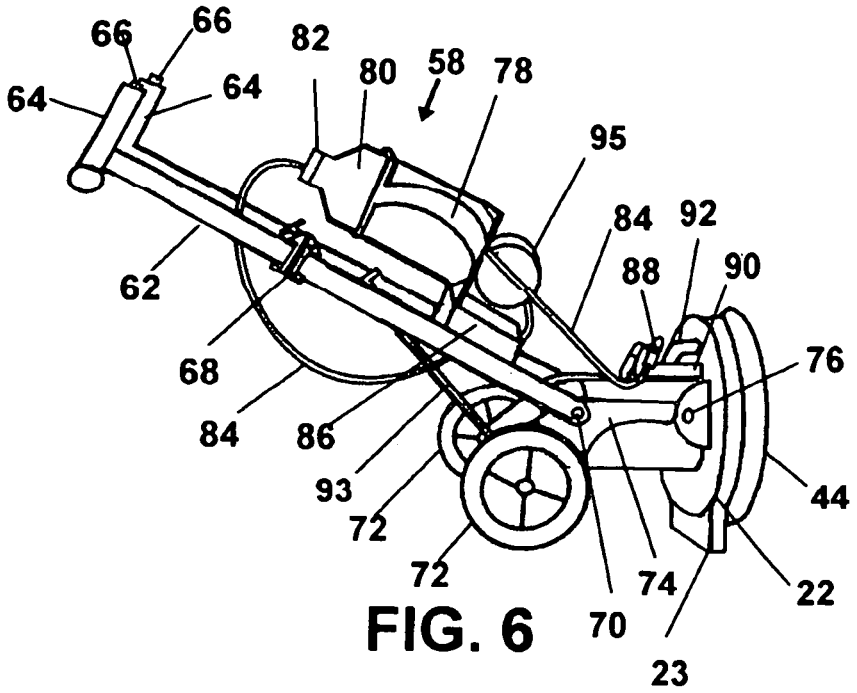
FIG. 6 shows a view of the device of FIG. 4 in a maintenance mode, where the device with the handle in the tipped position at an angle, and showing depicting rotationally engaged head in a perpendicular position to the support surface.
Figure 7:
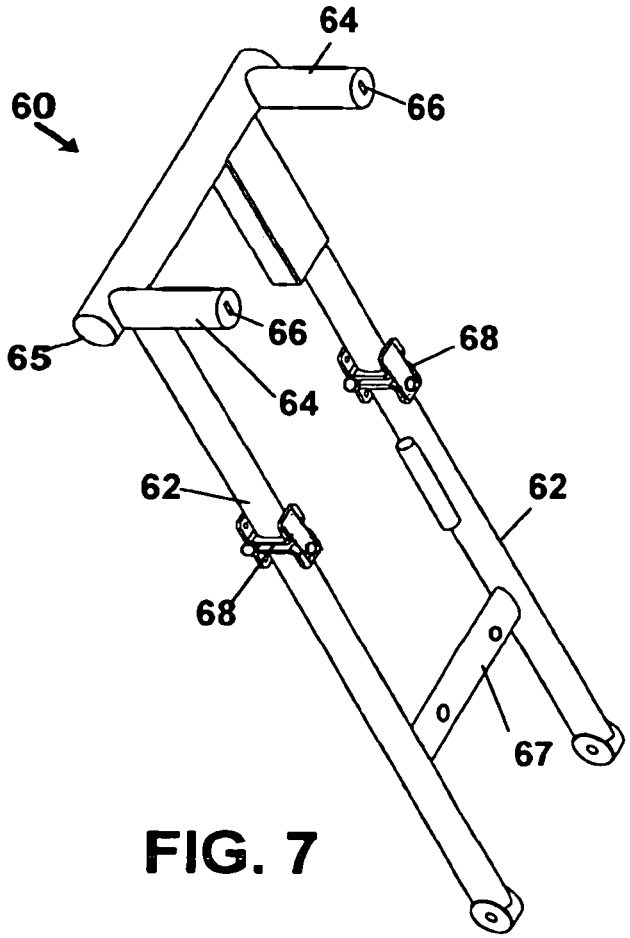
FIG. 7 shows a view of a particularly preferred mode of the handle assembly of the device employing hinged connectors which allow the assembly to fold into the stored mode of FIG. 6.

A preferred mode of the handle assembly 60 shown in FIG. 7 is preferably rotationally engaged 70 to lever arm 74 which is in turn rotationally engaged 76 to the head assembly 12. By rotationally coupling the head assembly 12 at one end of arm 74 allows the head assembly 12 to rotate into a cleaning position or a maintenance position as shown in FIG. 6. A handle 92 may be provided to aid the user to rotate the head assembly 12 into the position shown. Lever arm 74 allows the head assembly 12 to flip up into vertical maintenance position (FIG. 6) to allow a non-technical user to replace pads on the pad driver 44. As shown, in some modes, pad driver 44 can include hook-and-loop pad fastener. Pad fastener holds cleaning pads firmly on pad driver 44. One should note that handle assembly 60 is able to retain its position during a maintenance operation. A planar member forming a bumper 22 is provided and includes an protruding foot portion 23 to allow the head assembly 12 to rest on its end when in the maintenance position as shown.

Handle assembly 60 pivots 70 on an elbow of lever arm 74. The head assembly 12 is pivotably coupled 76 to an end of lever arm 74 allowing the head assembly 12 to operate in horizontal cleaning position (FIG. 4) while handle assembly 60 can change positions freely. Handle assembly 60 can also include locking lever 93, which can be disposed between the handle struts 62. Locking lever 93 allows a user to position handle assembly 60 into a desired working angle relative to a cleaning surface. Lever 93 preferably operates as a pull latch that catches on a sliding rod, which in turn holds handle assembly 60 into a set position.

Figure 5:
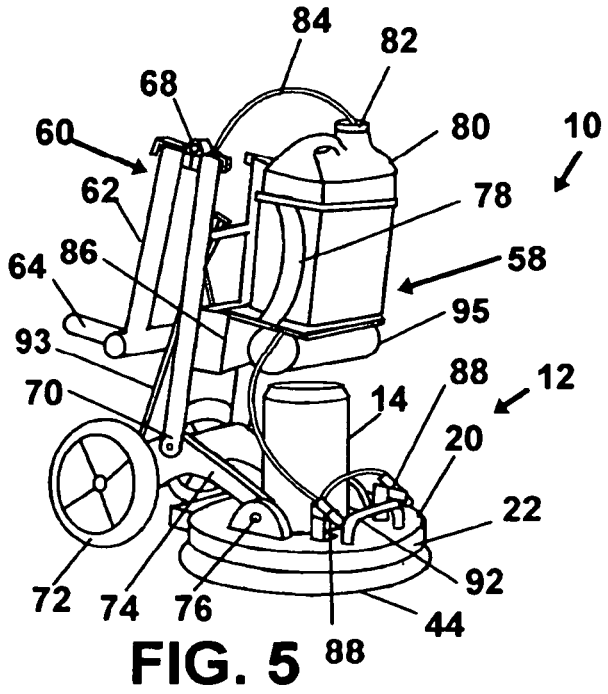
FIG. 5 illustrates the device of FIG. 4 where the handle assembly has been folded down for transport or storage where the device may be tipped at an angle to elevate the pad during rolling or towing.

FIG. 5 illustrates the collapsible nature of handle assembly 60. In the example shown, handle assembly 60 includes a hinged connector 68 allowing a portion of handle assembly 60 to fold back against itself through an angle of about 180 degrees. Thus, the device 10 can be folded down in a manner where its maximum dimension is minimized (for example no more than 30 inches~76.2 centimeters).

The device 10 include a spray assembly 58 comprising a replaceable bottle cartridge 80 which engages into a bottle holder frame 58. The replaceable bottle cartridge 80 allows users to quickly and easily swap out pre-mixed fluids. Fluid communication conduits 84 extend through an engagement with the lid 82 of the bottle 80, to a pump 86, to an optional heating element 95, and to one or a plurality of spray nozzles 88. As such the fluids are communicated from the bottles 80 to the nozzles 88 via the pump 86, which is mounted to the cross member 67 extending between the struts 62. The nozzles 88 may be rotationally engaged to mounting brackets 90 to allow the user to selectively position the nozzles 88. Actuation means 66 may be provided on the grips 64 of the handle assembly 60 to allow the user to initiate power to the pump 86, heating element 95, and motor 14. For example, actuators 66 can toggle power to driver motor 14, operate pump 86 to spray liquid from the bottle 80, adjust oscillation rate, or the other parameters of the claimed device. Pump 86 can be disposed below bottle holder 58 and engaged on a cross bar 67 of handle assembly 60. The bottle holder 58 can mount on to the cross bar 67 of handle assembly 60 or could be mounted directly to the struts 62 of handle assembly 60.

FIG. 8 shows a view of a particularly preferred replaceable bottle cartridge system 94 which can be operatively employed with the spray assembly 58 of the device 10. In this system, the bottle holder frame 102 includes protrusions 104, which hold the bottle cartridge 96 in place during operation of device 10. The frame 102 is sized and dimensioned to fit snug around the cartridge 96. The frame 102 also includes mounting surface 110 for mounting to the cross member 67 of the handle assembly 60 and a container 112 for a heater.

Protrusions 104 form a pinch point for cartridge 96. The frame 102 additionally includes a piercing member 108 extending from a surface 106 of the frame 102. The piercing member 108 is preferably in a fluid communication with the conduits 84 communicating with the pump 86 and optional heater 94. As the bottle 96 is lowered into the frame 102, the piercing member 108 may pierce the bottom surface 98 of the bottle 96 in fluidly sealed engagement and therefor provide a means to communicate the contained fluid to the communicating conduit 84. The bottom surface 98 of the bottle 96 may include a weaken portion 100 to easily allows the bottle 96 to be pierced. The bottle cap 97 can also include a breather valve, which allows air to be drawn into the bottle 96 as the pump 86 draws solution out of the bottle 96. Under such a circumstance, the bottle 96 retains its shape, does not collapse, or does not vibrate within the cage of on the machine.

FIG. 9 shows another preferred mode of a replaceable bottle cartridge system. In this mode, a removably cartridge 120 of solution concentrate may be provided which can be engaged to a main bottle 114 of simply water or other fluid. The main bottle 114 can include a housing 116 and piercing member 118 which can pierce the concentrate cartridge 120 in sealed engagement to communicate the concentrate solution into the main bottle 114 in a pre measured manner which is easy for non technical users. The main bottle 114 may include fill lines 115 to aid the user in properly filling the bottle 114 initially with water.

One should note that the various elements of the disclosed device 10 (e.g., pump, bottle cartridge, motor, spray nozzles, pads, driver plates, etc.) can be field replaceable by nontechnical users. Other preferred modes of the surface cleaning device 10 can include one or more of the following features:

- The apparatus can transform from a non-spraying unit to a spraying unit. A spray system can be attached to or removed from the apparatus through a mounting system comprising of a small number of mechanical fasteners.
- The bottle cartridge system allows for the changing of premixed solution bottles quickly thus eliminating spills and reduces overall weight of apparatus for lifting and storage.
- Contemplated spray systems allow for creating an equal flow pattern that can be applied directly to a floor area. Such an approach reduces solution streaks that cause uneven dry patterns.
- The spray system can also include a flow control system that controls the flow rate. Flow settings can range from off, to a dribble, or up to 1 gallon per minute.
- The system can fold down to 30" (plus or minus 6") in height which makes the apparatus easy to transport and store.
- The driver base can flip up for quick and easy pad changing.
- The apparatus can support different drivers. For example, a 17 inch apparatus can quickly and easily be converted to a 19 inch and 21 inch apparatus, and vice versa a 21 inch version can be converted to a 17 inch or 19 inch apparatus. One apparatus fits all driver options.
- Contemplated apparatus can include large wheels (e.g., 10 inch diameter) wheels for overcoming any type of staircase, steps, curbs, holes, and or other obstacles in its path.
- The apparatus can be manufactured with a weight of less than 85 lbs.
- The vertically disposed hand grips provide for easy operation and lower back stress relief.
- A one horsepower universal 110V/60 Hz.-220V/50 Hz. motor can be configured to operate as the driver motor to deliver over 1700 oscillations per minute.
- An electrical cord can be included that can be easily removed.
- Valve System for Removing Air from Pump Lines
- Cleaning Pad Configuration: Cotton, Polyester, Bamboo
- Removable Cleaning Liquid Management System with Vibration Isolation
- Extension Plug(s)
- Shaft Support for Drive Shaft
- Glider System for Friction Adjustment of Cleaning Pad
- Motor Modifications
- Misting System to Prevent Pad Saturation
- Brush Pads
- Heater System
- Hinge System Some of these features will now be discussed in more detail.

Valve System for Removing Air from Pump Lines

An orbital floor cleaner can include a three way port valve system to maintain and manage flow from a cleaning tank to a cleaning head via a pump system. The value can include a lever capable of redirecting flow in the line. When the lever is toggled, air trapped in the pump or solution line can be directed back through a return line into the tank by running the pump for a few seconds. Returning the lever back to an original position allows for solution to be directed back to spray nozzles.

Cleaning Pad Configuration for Carpeted Surfaces: Cotton, Polyester, Bamboo

Conventional orbital floor cleaners lack properly constructed cleaning pads capable of efficient soil extraction yet allowing for proper maneuverability. Known cleaners require the operator to overcome resistance of a pad as it cleans. A preferred cleaning pad comprises a mix of materials that provide for excellent soil extraction while reducing friction so that the operator does not become overly fatigued. Preferred pads comprise a mix of cotton, polyester, and bamboo fibers. Pads preferably have a mix of materials by weight as follow: from about 0% -20% cotton, about 40% -65% polyester, and about 35% -40% bamboo. Bamboo fiber (viscose) provides desired cleaning properties while also reducing friction. Furthermore, pads have bamboo fibers having an average length between 0.01 inches to 1.0 inches can achieve proper function. In other embodiments the pad comprises cotton and polyester.

Another possible clean pad configuration can comprise the SUPERZORB pad offer by Hruby Orbital Systems. The SUPERZORB pads are 1300 GSM (plus or minus 400) having a pile of yarn. Preferably the yarn comprises a 2 ply yarn in a blend of about 40% polyester and 60% cotton on a base of content (plus or minus 10% for each material). Preferred yarn 8 count is 2/7.

Removable Cleaning Liquid Management System with Vibration Isolation

Conventional orbital floor cleaners produce quite a bit of vibration, which can cause undesired movement of various attached parts. Vibration can be quite severe especially for removable attachments including solution bottles, pumps, or other parts. A preferred mode of the cleaner 10 comprises a cleaning solution cartridge system having a cage mounted on handles of the cleaner. The cage can be sized and dimensioned to hold a cleaning solution tank. The cage can include a tank receiving opening. The cage can further include one or more narrowed portions (e.g., pinch points) configured to grip the tank and hold the tank in place during operation. The system can further include a tank cap having input/output lines that can be moved from tank to tank. As the cleaner operates, the narrowed portions of the cage hold the tank firm and the tank cap hold the input/output lines in place. When a tank is empty, the entire tank can be replaced or refilled as desired.

Extension Plug(s)

Conventional orbital floor cleaners typically have long extension cords to allow for long distance use from an outlet. In many situations an operator often finds they must use an additional power tool at the cleaning site. However, no outlet socket is available. A preferred mode of the cleaner 10 includes an extension plug capable of providing electrical power to power tools. In addition, preferred cleaners also includes a quick connect extension cord. One can simply twist together sockets in a clockwise motion to fasten the cords together, or untwist in a counter clock wise motion to unfasten the cords.

Shaft Support for Drive Shaft

Conventional orbital cleaners comprise a drive shaft coupling the motor of the cleaner to the pad driver element. Unfortunately, due to the orbital motion, the drive shaft can become worn due to vibration. A preferred mode of the cleaner 10 comprises a shaft support configured to allow for vibration when attached to a cleaning pad (see section labeled: Cleaning Pad Configuration: Cotton, Polyester, Bamboo). Contemplated shaft supports comprise a shaft support configured to shroud and reinforce the drive shaft against stresses resulting from vibration of the orbital assembly during use.

Shaft support comprises a cylindrical member that has a through hole extending axially throughout the length of the cylindrical member. The through hole is axially aligned with the cylindrical member with a high degree of precision. The cylindrical member also has a flanged end. The flange extends circumferentially from the cylindrical member at a 90 degree angle with a high degree of precision. The length and outer diameter of the cylindrical member, the inner diameter of the through hole, the diameter and thickness of the flange, and the material composition of shaft support is not mere design choice. These parameters are carefully selected to provide sufficient support and reduce vibration in the cleaning apparatus, while still allowing the driver and the brush pad to have a desirable amount of flexibility.

From a methods perspective, the present inventive subject matter comprises providing a motor drive shaft and conditions in which the motor drive shaft will be used (e.g., carpet vs hardwood), selecting parameters for a shaft support, and ascertaining vibration and performance (dirt extracted, agitation forces, etc.) in the cleaning apparatus. The method can further include the step of re-selecting parameters and re-ascertaining vibration/performance in an reiterative manner in order to provide an acceptable shaft support. The selection of shaft support parameters achieves a sufficiently close tolerance fit between the motor drive shaft and the shaft support such as to eliminate lateral migration of the orbital floor cleaning apparatus on the work surface under cleaning conditions. In preferred embodiments, the orbital cleaner travels less than 1 foot per 30 seconds, more preferably less than 6 inches, most preferably less than 2 inches. Once the shaft support has been selected, the method can include an additional step of coupling the shaft support to the motor drive shaft.

Close tolerance fit between the motor drive shaft and the shaft support is meant to include (1) axial fit to reduce axial wobble of the shaft support around the motor drive shaft, 10 (2) flange wobble around a hypothetical 90 plane intersecting the rotational axis of the motor drive shaft, (3) vertical slip between the motor drive shaft and the shaft support.

Glider System for Friction Adjustment of Cleaning Pad

A preferred mode of the cleaner 10 comprises a glider system comprising at least two gliders. Gliders for the device 10 would include two gliders each measuring 8" in diameter. A first glider can be 1/16th inch thick and a second glider can be is 1/8th inch thick. Both gliders can have a hook fastening system on one side that coupled with a cleaning pad. The gliders reduce the amount of friction between different carpet types and the cleaning pads, allowing the operator to maneuver the cleaner with more ease if necessary. Such a configuration cooperates with the disclosed pads as discussed above.

Motor Modifications

Conventional orbital cleaners utilize off the shelf motors, which causes undue stress on the machine because each machine has a different configuration. Consequently, a common motor that might work for a first machine would unlikely work for a second machine due to differences in weight distribution. A preferred mode of the cleaner 10 have numerous characteristics that surprisingly reduce vibration. For example the motor 14 has the following characteristics:

- 3/8th-24 inch pin length of 0.900 +−0.05
- Shaft length of 1.6 inches from C-face base
- Shaft diameter of 0.625 inches
- Motor weight of 27 pounds +−1 pound
- 1725/1451 RPM, counter clockwise rotating motion, 56C frame, TEFC, 50/60 Hz, 100V-230V Misting System to Prevent Pad Saturation Conventional orbital floor cleaners inject cleaning solution through an upper surface of a cleaning pad. Such an approach causes the cleaning pad to become saturated and have reduced efficiency when cleaning. A preferred mode of the cleaner 10 comprises a spray system having one or more nozzles that direct a mist of cleaning solution directly on to a surface to be cleaned in front of the machine. Such an approach provides for even coverage under control of an operator, efficient soil extraction from the surface, or reduced drying times for carpets. In some embodiments, the spray nozzle arms can maneuver up, down, left, or right to allow the operator to adjust his cleaning speed, spot cleaning, or other types of spraying needs when cleaning different types of floors.

Brushes

Beyond buffing or cleaning pads, an orbital floor cleaning device 10 can also utilize one or more brush pads. Preferred brush pads use small diameter bristles (e.g., less than 0.03 inches, or about 0.02 inches) so that pores, crevices, grout lines, or other surface features can be cleaned efficiently. Bristles preferably comprise a stiff material (e.g., nylon 6-12) where bristles, in aggregate, bear the weight of the cleaners while also provide efficient cleaning tips. Furthermore, preferred brush pads have bristles oriented at various angles in concentric rings about the brush pad. Each ring can have bristles oriented at increasing angles to a neighboring ring.

Brush pad can include multiple concentric rings of bristles where the pad has at least three, and more preferably at least seven rings. One should note that each group of bristles in each ring can have different bristle length relative groups in other rings. The outer ring of bristles have a length about of about two inches where the inner most row has bristle length of about 1.3 inches. The following table provides the parameters of the illustrated brush pad.

| Ring | Bristle Length (in) | No. of Bristle Groups | No. of Bristles in Group | Angle of Bristle Group (degrees) | Dist. from Pad Edge to Center of Group (in) |
|---|---|---|---|---|---|
| 1 (Outer most) | 2.0 ± 0.2 | 83 | 40 ± 5 | 60 ± 10 | 0.250 ± 0.2 |
| 2 | 1.4 ± 0.2 | 79 | 70 ± 5 | 60 ± 10 | 0.875 ± 0.2 |
| 3 | 1.3 ± 0.2 | 75 | 70 ± 5 | 60 ± 10 | 1.50 ± 0.2 |
| 4 | 1.3 ± 0.2 | 40 | 70 ± 5 | 75 ± 10 | 2.00 ± 0.2 |
| 5 | 1.3 ± 0.2 | 36 | 70 ± 5 | 75 ± 10 | 2.75 ± 0.2 |
| 6 | 1.3 ± 0.2 | 30 | 70 ± 5 | 90 ± 10 | 3.25 ± 0.2 |
| 7 (Inner most) | 1.3 ± 0.2 | 16 | 70 ± 5 | 90 ± 10 | 3.75 ± 0.2 |

Although the above table provides a very detailed view of a possible brush pad, one should appreciate variation around the parameters is also contemplated. The angles, number of groups, number of bristles within a group, number of rings, or other factors can be varied. Still, one should further appreciate that such factors are more than mere design choice. The angles, bristle material, placement of groups, or other parameters are selected to achieve desire cleaning efficiency.

The pad is mounted to the cleaners counter weights via one or more mechanical fasteners (e.g., four ¼th inch screws).

Heater System

Preferred orbital cleaners comprise a removable heater cartridge. The heater cartridge can include a high watt heater 94 and positioned near a cleaning solution tank. As the system draws solution from the cleaning solution tank, the heater cartridge can heat the solution before the solution is sprayed on to the floor.

Additional Features

The base can include a bumper with a resting block 23, which can be considered a bumper foot or it may be wheeled to allow for rolling engagement. The bumper foot allows an operator to flip up the base and rest the base in a vertical position allowing the operator to change out pads, scrub brushes, or any other accessory from the driver plate.

The driver plates can also include hook and loop fastener (e.g., VELCRO) driver plates. The driver plate allows the operator to change the hook and loop fastener plates when the plates wear out. Changing out these plates ensures the cleaning pads (e.g., SuperZorb pad, etc.) are driven by the driver at a desirable production rate. The plates are can be about 1/16" thick, about 15" in diameter, made from ABS plastic, and can be mounted with 8 pcs of ¼" screws. Changing the weight, dimensions, or other aspects of the plate designs will cause the orbital drive to operate with less than desirable efficiency, therefore the machine will not perform smoothly and accurately.

An actual pad driver that fastens to the hook and loop fastener driver plates play an assisting role in balancing the orbital drive and will also aid in making the machine operate properly. Pad drivers can be made of ⅜" thick PVC and are about 15" in diameter. The actual pad driver can mount to the orbital counterweight directly with 4 pcs of ¼" screws.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A floor treatment device, comprising:

a handle assembly having a pair of handles at a first end and having a second end opposite said first end;

a frame rotationally engaged to said second end of said handle assembly;

a head assembly, said head assembly rotationally engaged to said frame at one or more pivot points engaged to a planar member;

said head assembly having a motor engaged thereto upon said planar member;

a drive shaft of said motor communicating through said planar member to operatively engage with a flywheel along a center axis running along a line through said drive shaft and through a center of said flywheel;

said flywheel having a first side surface on a first of two sides and a second side surface parallel to the first side surface on a second of said two sides;

a bearing assembly engaged to said second side surface, said bearing assembly offset a distance from said center axis;

said bearing assembly having a bearing retainer surrounding an engaged bearing;

a substantially planar pad drive member engaged on an upper surface to a center area of said bearing, said pad drive member rotatable around a second axis, offset from said center axis, extending along a line from said center area;

said pad drive member configured for an engagement with a pad upon a lower surface, opposite said upper surface;

rotation of said motor imparting a rotation to said flywheel which imparts rotation and a concurrent orbital motion to said pad drive member and any said pad engaged thereto;

a first plurality of weights in a first paired engagement upon opposite respective sides of said two sides of said flywheel;

a second plurality of weights in a second paired engagement on said opposite respective sides of said two sides of said flywheel;

said second plurality of weights being lighter than said first plurality of weights in an unequal weight distribution;

said unequal weight distribution inducing an enhanced thrust motion moment to said pad drive member and enhancing said orbital motion during said rotation of said flywheel; and a rotation of said head assembly, at said pivot point with said frame providing means for said pad and said pad drive member and said motor and said flywheel, to concurrently tilt while in operative engagement, during an encounter with an uneven surface by said pad.

2. The floor treatment device of claim 1 additionally comprising;

said handle assembly having two parallel members extending along a first plane, from said handles to said second end of said handle assembly;

said handles extending in an orthogonal direction from said first plane; and said handles extending in said orthogonal direction providing means of minimizing communication of vibration along said two parallel members to said handles.

3. The floor treatment device of claim 2 additionally comprising;

said handles providing means for ergonomic gripping by hands of a user operating said floor treatment device maintaining forearms of said user gripping said handles along a line running from a thumb of said user, in line with biceps of said user.

4. The floor treatment device of claim 1 additionally comprising;

said handle assembly having two parallel members extending along a first plane; from said handles to said second end of said handle assembly;

said handles extending in an orthogonal direction from said first plane; and said handles providing means for ergonomic gripping by hands of a user operating said floor treatment device maintaining forearms of said user gripping said handles along a line running from a thumb of said user, in line with biceps of said user.

* * * * *